United States Patent [19]

Mitsui

[11] 4,296,489

[45] Oct. 20, 1981

[54] ELECTRONIC TIMEPIECE

[75] Inventor: Hiromitsu Mitsui, Suwa, Japan

[73] Assignee: Kabushiki Kaisha Suwa Seikosha, Tokyo, Japan

[21] Appl. No.: 33,277

[22] Filed: Apr. 25, 1979

Related U.S. Application Data

[63] Continuation of Ser. No. 678,339, Apr. 19, 1976, abandoned.

[30] Foreign Application Priority Data

Apr. 17, 1975 [JP] Japan ..... 50-46728

[51] Int. Cl.[3] ..... G04B 1/00

[52] U.S. Cl. ..... 368/205

[58] Field of Search ..... 58/23 R, 23 BA, 23 C, 58/50 R, 127 R; 136/89 R, 89 P, 89 CC; 174/117 A; 368/205

[56] References Cited

U.S. PATENT DOCUMENTS

| | | | |
|---|---|---|---|
| 3,731,474 | 5/1973 | Tsuruishi | 58/23 C |
| 3,762,946 | 10/1973 | Stow et al. | 174/117 A |
| 3,786,624 | 1/1974 | Uchiyama | 58/23 C |
| 3,983,689 | 10/1976 | Burke et al. | 58/50 R |

*Primary Examiner*—Vit W. Miska

*Attorney, Agent, or Firm*—Blum, Kaplan, Friedman, Silberman & Beran

[57] ABSTRACT

An electronic timepiece including a primary battery as a power source, and a solar battery for charging the primary battery is provided. The electronic timepiece includes a solar battery for producing a charging current in response to solar light being incident thereon, a primary battery adapted to be charged by the charging current and a detecting circuit disposed intermediate the solar battery and the primary battery to detect the state of charge of the primary battery and in response thereto selectively decouple the solar battery from the primary battery. The solar battery can be formed of a plurality of equal area solar cells forming a dial having a non-circular configuration.

1 Claim, 10 Drawing Figures

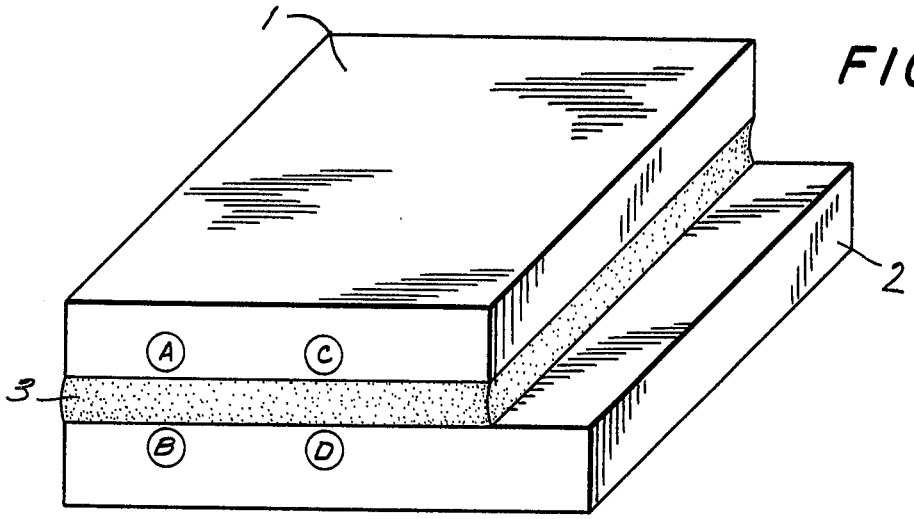
FIG. 7
FIG. 8-1
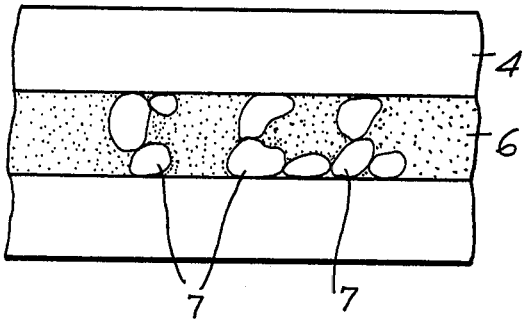
FIG. 8-2
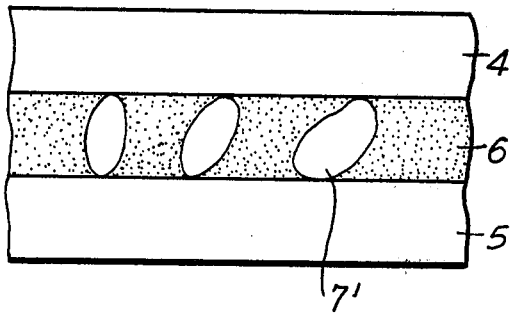
FIG. 9
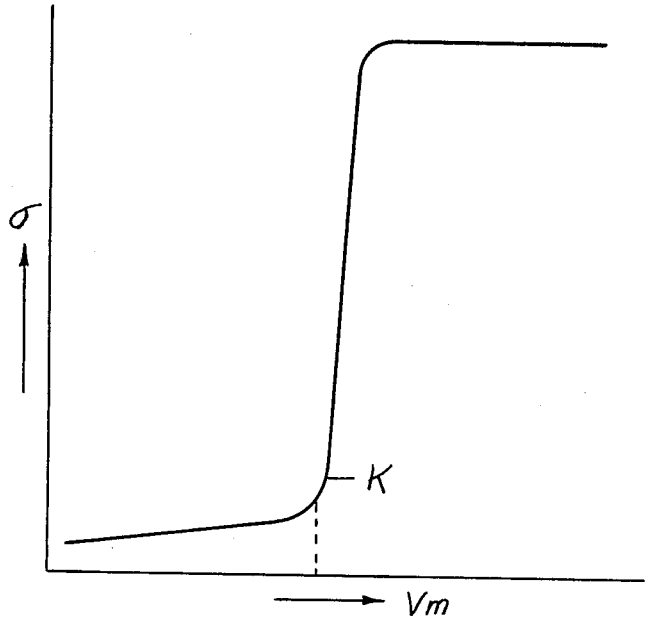

ELECTRONIC TIMEPIECE

This is a continuation, of application Ser. No. 678,339, filed Apr. 19, 1976, now abandoned.

BACKGROUND OF THE INVENTION

This invention is directed to an electronic timepiece having a primary battery power source adapted to be charged by a solar battery, and in particular to an electronic timepiece circuit for detecting the state of charge of a primary battery and selectively gating thereto the charging current produced by a solar cell.

Although electronic timepieces utilizing solar batteries for converting solar light incident thereon to a charging current for charging an electronic timepiece power supply have been provided, such solar battery arrangements have been utilized to charge a secondary battery, such as a nickel-cadmium battery. The secondary battery is utilized to drive the timepiece circuitry and is continually recharged by charging current supplied by the solar battery. Nevertheless, such a prior art secondary battery although capable of charging and discharging, is susceptible to internal leakage, resulting in a loss of charge. A further problem with conventional secondary batteries is that space must be left in the container forming same to permit sufficient space for the evolved gas produced during self-discharge. Nevertheless, because of the small size of an electronic wristwatch, the extra space in the container mitigates against providing a small-sized secondary battery for use in the electronic timepiece. Finally, when utilizing prior art secondary batteries within an electronic wristwatch, a damper must be provided in the battery containing portion to increase the volume, and accordingly a lead wire cannot be pressed against the battery to connect same but instead, a lead wire is required to be electrically connected by soldering or the like. Such soldering clearly increases the difficulty in replacing such batteries.

SUMMARY OF THE INVENTION

Generally speaking, in accordance with the invention, an electronic timepiece assembly utilizing a primary battery and solar battery is provided. The solar battery produces a charging current in response to solar light being incident thereon. A primary battery is adapted to be charged in response to a charging current being applied thereto. A detecting circuit is disposed intermediate the solar battery and primary battery to detect the state of charge of the primary battery and in response thereto selectively decouple the solar battery from the primary battery.

Accordingly, it is an object of the instant invention to provide an electronic timepiece including a primary battery charged by a solar battery, wherein overcharging of the solar battery is prevented.

Still another object of this invention is to utilize a primary battery as a storage battery in an electronic timepiece by charging same with a solar battery.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 7–8-1 and 2 illustrate conductive anisotropic adhesive layers.

FIG. 9 shows a conductivity graph of the adhesive layer of FIGS. 7–8.

DETAILED DESCRIPTION OF THE PREFERRED EMBODIMENTS

Figure 1:
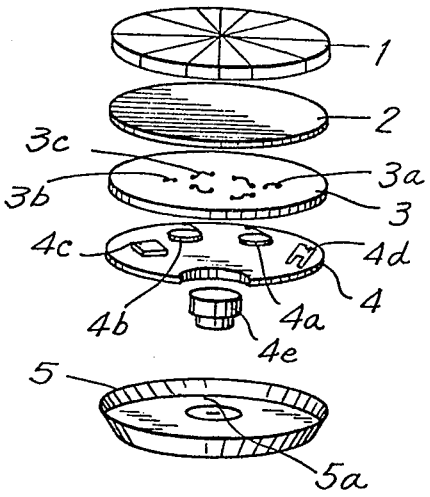
FIG. 1 is a perspective view of an electronic timepiece utilizing a solar battery as a dial and constructed in accordance with the instant invention.

Reference is now made to FIG. 1, wherein an electronic wristwatch utilizing a silver or mercury primary battery **4*e* as a power source is depicted. Solar battery 1 is suitably divided into a discrete number of cells and is utilized as a watch dial in a manner to be discussed more fully below with respect to FIGS. 5 and 6. A conductive rubber or adhesive layer 2 is coupled to the solar battery for coupling the solar battery to a circuit substrate 3. The conductive adhesive 2** is an anisotropic conductive layer capable of conducting current in the direction of thickness only.

As is illustrated in FIG. 7, an adhesive layer capable of possessing conductive anisotropy in a first direction and insulative properties in a second direction is illustrated. Specifically, the adhesive layer 3 is disposed between base plates 1 and 2 so that the adhesive layer will be electrically conductive in the directions A→B and C→D and will function as an insulator in the direction A→D and C→B.

This result is obtained by dispersing grains of noble metals, heavy metals, light metals, alloys or gilding grains having electrical conductivity properties in an adhesive having an insulating property such as epoxys, silicons, etc. Moreover, it is necessary to control the amount, shape, size, state of dispersion, thickness and manner in which each of the grains are adhesively secured together in order to obtain the optimum result.

FIGS. 8(1) and 8(2) illustrate two adhesive layers, having conductive anisotropy. The adhesive layers 6, including conductive grains 7 and 7', are formed between plates 4 and 5. In FIG. 8(2) the grains 7' are almost the same size and thickness as the adhesive layer 6. Thus, as illustrated in FIG. 8(2), the conductivity of the adhesive layer 6, through the respective grains, is obtained at the point of contact. It is noted, however, that at the point of contact, there is usually a high contact resistance. For this reason, a plurality of grains, of the type illustrated in FIG. 8(1), is usually preferred. FIG. 9 is a graphical illustration pointing out the electrical conductivity characteristics of the compositions made by dispersing the conductive grains in adhesives having insulating properties, wherein Vm represents the ratio of conductive grains to the adhesives with the horizontal axis representing the insulating property and the electrical conductivity being represented by the vertical axis. If the ratio of conductive grains drops below a certain value (K), the electrical conductivity becomes extremely low. However, if it is above the point K, a satisfactory electrical conductivity will be obtained.

By way of explanation, when a specific quantity of conductive powder is added to the adhesive, a conductive state is obtained in the direction of thickness whereas a non-conductive state is obtained in the planar direction. Thus, when the conductor is thinned and disposed between the solar battery 1 and circuit substrate 3, conductive electrodes on the surfaces of both elements, if in alignment, will be coupled together by the adhesive layer 2. The adhesive material is formed by utilizing a material such as cobalt powder, which is responsive to magnetic energy, by mixing same in the adhesive. Thereafter, a magnetic field is applied from both sides of the material to orient same in a first direction. Accordingly, if the powder is oriented and conducted in the thickness-direction of the adhesive layer, an anisotropic conductor that conducts in the thickness direction and isolates in a direction transverse thereto is provided.

The circuit substrate 3 includes leads coupled through the thickness thereof so that the solar battery 1 is thereby coupled to a circuit base plate 4 and the elements secured thereto. Specifically, springs 4*a* and 4*b* are provided on the circuit plate 4 for coupling the leads on the circuit substrate 3 to the battery 4*e*. Additionally, an integrated circuit chip 4*c* and quartz crystal vibrator 4*d* are also coupled to the circuit substrate 4 for providing the timekeeping circuit elements of the electronic timepiece. A back cover 5 including an inwardly projecting portion 5*a* is brought into contact with the battery 4*e* to secure same in the electronic timepiece. Accordingly, the electronic timepiece is formed by layering each of the respective elements depicted in FIG. 1 in a wristwatch case.

Figure 2:
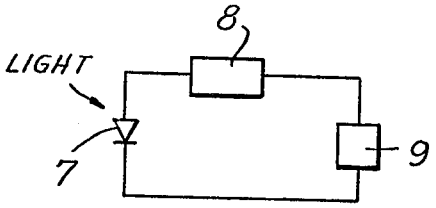
FIG. 2 is a block circuit diagram of a battery charging circuit constructed in accordance with a preferred embodiment of the instant invention.

Reference is now made to FIG. 2, wherein a block circuit diagram of the instant invention is depicted. A solar battery 7 is coupled through a limiter 8 to the electronic timepiece load 9, including the electronic timepiece power source. Specifically, the limiter 8 is adapted to avoid overcharging of the battery and to limit providing excess current to the timekeeping circuitry by the solar battery 7. Accordingly, the limiter 8 is coupled intermediate the solar battery 7 and timekeeping circuitry 9 to thereby decouple the solar battery when the power source of the electronic timepiece is overcharged or when the power source is dead (is no longer capable of producing current at a useful voltage to drive the electronic timepiece).

Figure 3:
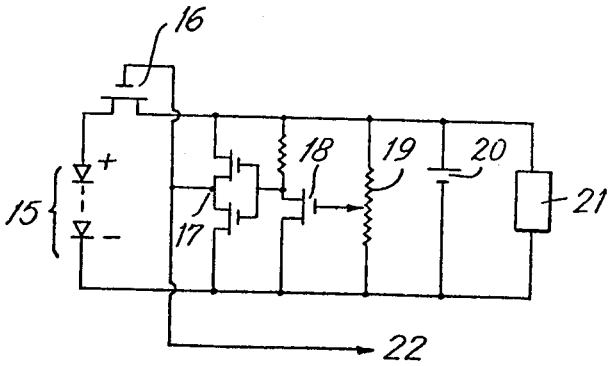
FIG. 3 is a detailed circuit diagram of the block circuit diagram depicted in FIG. 2.

Referring specifically to FIG. 3, a detailed circuit diagram of the circuit depicted in FIG. 2 is illustrated. A solar battery 15 formed of a plurality of series-connected solar cells is coupled through the source-drain path of a MOS transistor 16 to a charge accumulator 20, which charge accumulator is a primary battery. Coupled in parallel with the primary battery 20 is a load 21, which load represents the movement in an electronic timepiece. The gate electrode of the MOS transistor 16 is coupled through an inverter circuit 17, MOS transistor 18 and potentiometer 19, which elements comprise a detecting and limiting circuit for preventing overcharge of the primary battery 20 or alternatively for detecting a sufficient decrease in the state of charge of the primary battery 20 so that same is no longer capable of providing sufficient current at a useful voltage for driving the load 21. Specifically, the potentiometer 19 protects the voltage of the primary battery 20 and applies the potential thereof to the gate electrode of MOS detecting transistor 18. The source-drain path of the MOS detecting transistor 18 is coupled to the input of a C-MOS inverter circuit 17, which circuit effects an inversion and amplification of the signal produced by the detecting transistor 18 to thereby control the potential applied to the gate electrode of the MOS transistor 16. Additionally, a terminal 22 coupled to the gate electrode 16 can be utilized as a detecting electrode for providing a signal indicating when the state of charge of the battery is sufficiently decreased so as to render the battery no longer effective or when the battery is being overcharged.

When the circuit depicted in FIG. 3 operates to detect that the primary battery is no longer capable of producing current at a useful voltage to drive the timekeeping circuitry, the following operation occurs. The MOS transistor 16 is normally maintained in an ON condition so that the solar battery 15 is coupled to the primary battery and continues to energize same. In order to maintain transistor 16 in an ON state, the potentiometer 19 and MOS detecting transistor 18 are so disposed as to maintain the transistor 18 in an ON state when the state of charge of the primary battery 20 is sufficient to produce current at a useful voltage for driving the load 21.

When the transistor 18 is ON, the input to the C-MOS inverter-amplifier circuit 17 is coupled to the reference potential of the system and accordingly a "0" signal is applied to the input of the inverter-amplifier circuit 17, and thereby effects an application of a "1" signal to the gate electrode of the MOS transistor 16 to render the source-drain electrodes conductive. When the voltage of the primary battery 20 is sufficiently decreased so as to signify that the primary battery has been exhausted or is about to become exhausted, the drop in voltage is detected by the potentiometer 19 and detecting transistor 18 and thereby turns the detecting transistor 18 OFF. The input to the inverter-amplifier circuit 17 is thereby referenced to a higher potential and produces a "0" output at the inverter, which output is applied to the gate electrode of the transistor 16 to thereby turn same OFF and effect a decoupling of the solar battery 15 from the primary battery 20. The change in the signal utilized to control the gate electrode of the transistor 16 can also be applied through a lead 22 to appropriate monitoring circuitry to thereby provide the wearer of the timepiece with an indication that the primary battery must be replaced.

It is further noted that when the detecting circuitry illustrated in FIG. 3 is utilized to prevent overcharging of the primary battery, the transistor 16 will be utilized to decouple the solar battery 15 from the primary battery 20, when the detection circuitry detects that the primary battery has been charged above a safe level. The use of a primary battery as an accumulator is set forth in detail in Japanese patent application No. 39614/74. It is noted that secondary batteries are not good storage elements since their charging and discharging times are generally short. However, when a silver battery or a mercury battery, known in the art as a primary battery, is charged at 1.7 V to 1.9 V at 250 mAH, no problems will occur. However it is noted that when the charging current voltage exceeds 1.95 V, the gas evolved by the overcharging will cause the battery container to begin to swell. Although the above-noted primary batteries are not capable of obtaining the sufficient charging and discharging that has heretofore been obtained with secondary batteries, experiments have demonstrated that when a primary battery is charged and discharged at low voltages of the type utilized to sustain operation in an electronic wristwatch, such primary batteries can be utilized as charge accumulators in the manner aforedescribed. Also, such experimentation has demonstrated that primary batteries utilized in the above-described manner remain perfectly normal and unchanged by such use.

Figure 4:
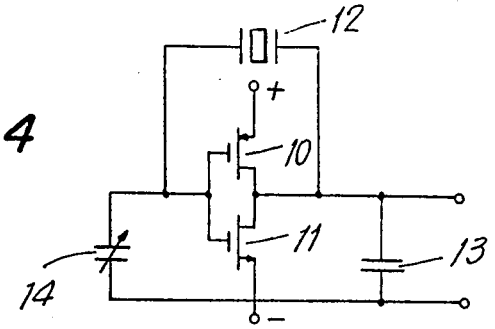
FIG. 4 is a detailed circuit diagram of an oscillator circuit constructed in accordance with the instant invention.

Reference is now made to FIG. 4, wherein a quartz crystal oscillator circuit particularly suitable for use in an electronic timepiece of the type illustrated in FIG. 1 is depicted. The quartz crystal vibrator 12 includes a C-MOS inverter circuit comprised of P-channel MOS transistor 10 and N-channel MOS transistor 11. The capacitors 13 and 14 are coupled between the respective drain output and gate input terminals of the C-MOS inverter, and variable capacitor 14 is effective in tuning the oscillating frequency of the oscillator circuit.

Figure 5:
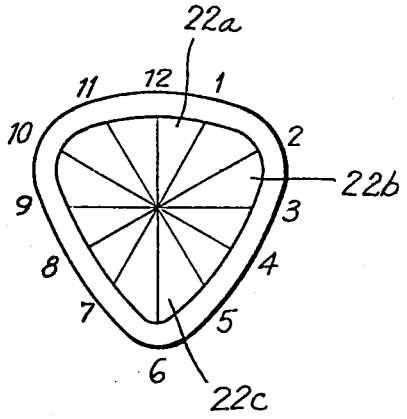
FIGS. 5 and 6 are plan views of solar batteries utilized as dials in an electronic timepiece in accordance with preferred embodiments of the instant invention.
Figure 6:
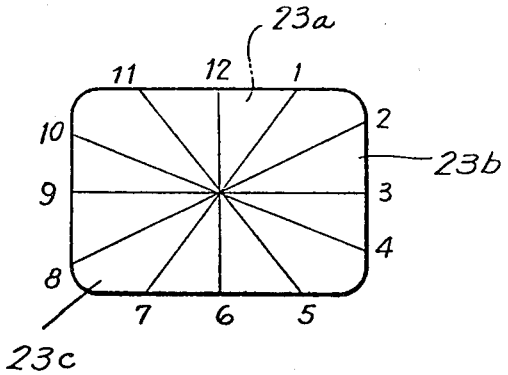

Reference is now made to FIGS. 5 and 6, wherein solar batteries having a non-circular form for use as a dial surface in electronic wristwatches are depicted. By utilizing twelve series-connected solar cells, twelve discrete areas can be provided for forming the watch dial. Nevertheless, when such a non-circular construction is utilized, each of the areas of the solar cells must be maintained equal in order to provide a sufficient solar battery for use in charging the primary battery. For example, in FIG. 5, solar cells 22*a*, 22*b* and 22*c* each have a different diametric distance from the central point of the dial and accordingly, the solar cells form different angles with respect to the center point in order to properly equalize the areas thereof. Specifically, a longer distance from the center point to the periphery will require a smaller angle in order to equalize the area with the solar cells having a smaller radius. In FIG. 6, the square-formed dial also illustrates the manner in which equal area sections 23*a*, 23*b* and 23*c* are provided.

It is noted that by providing an electronic timepiece with a primary battery capable of being charged by a solar battery, the reliability of a power source in an electronic timepiece is improved. Further improvement to the timepiece is provided by utilizing the anisotropic conductive adhesive for securing a solar battery utilized as a dial to the timekeeping circuitry, and finally, by utilizing detecting circuitry and overcharge prevention circuitry for decoupling the solar battery to the primary battery when same is overcharged or exhausted. Each of the advantages obtained by the instant invention improve the commercialization of such timepieces.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In an electronic timepiece including timekeeping circuitry having a solar battery for producing charging current in response to light being incident thereon, the improvement comprising said solar battery being formed of a plurality of solar cells, said solar cells being disposed on a surface of said timepiece, a circuit substrate including leads formed thereon for coupling said solar cells to said timepiece circuitry, and a conductive adhesive layer for physically securing said solar cells to said circuit substrate and for electrically coupling each of said solar cells to the leads on said circuit substrate, said conductive adhesive layer being conductive in a first predetermined direction perpendicular to the opposed surface thereof in contact with said solar cells and as an electrical insulator in the direction parallel to said opposed surface thereof.

* * * * *